US008182891B2

(12) United States Patent
Scott et al.

(10) Patent No.: US 8,182,891 B2
(45) Date of Patent: May 22, 2012

(54) RIGID RESEALABLE LABEL FLAP HAVING A HINGE

(75) Inventors: Barry M. Scott, West Bend, WI (US); James F. Konicke, Muskego, WI (US)

(73) Assignee: Prime Label & Screen, Inc., Pewaukee, WI (US)

( * ) Notice: Subject to any disclaimer, the term of this patent is extended or adjusted under 35 U.S.C. 154(b) by 484 days.

(21) Appl. No.: 12/338,105

(22) Filed: Dec. 18, 2008

(65) Prior Publication Data

US 2010/0154264 A1 Jun. 24, 2010

(51) Int. Cl.

| | |
|---|---|
| ***B32B 9/00*** | (2006.01) |
| ***B32B 33/00*** | (2006.01) |
| ***B65D 65/28*** | (2006.01) |
| ***B65D 17/34*** | (2006.01) |

(52) U.S. Cl. ..... 428/40.1; 428/42.2; 428/42.3; 428/43; 283/100; 283/101; 220/359.1; 220/359.2

(58) Field of Classification Search ..... 428/40.1, 428/42.2, 42.3, 43; 283/81, 100, 101; 206/233; 220/359.1, 359.2

See application file for complete search history.

(56) References Cited

U.S. PATENT DOCUMENTS

| | | | | |
|---|---|---|---|---|
| 2,878,988 | A * | 3/1959 | Kryeske | 229/92.9 |
| 5,035,518 | A | 7/1991 | McClintock | |
| 6,026,953 | A | 2/2000 | Nakamura et al. | |
| 6,767,604 | B2 | 7/2004 | Muir, Jr. et al. | |
| 7,051,877 | B2 | 5/2006 | Lin | |
| 2007/0095709 | A1 * | 5/2007 | Saito et al. | 206/494 |

FOREIGN PATENT DOCUMENTS

EP 1 780 145 A1 5/2007

OTHER PUBLICATIONS

EP Search Report dated Mar. 29, 2010.

* cited by examiner

*Primary Examiner* — Patricia Nordmeyer

(74) *Attorney, Agent, or Firm* — Andrus, Sceales, Starke & Sawall, LLP

(57) ABSTRACT

A resealable label flap is positionable to cover an opening in a package containing removable articles. The label flap includes a base layer extending between a first and a second end. The base layer includes a first adhesive on a bottom face surface and permits repeated application and separation of the base layer relative to the package. The base layer has a starting tab to permit removal of the base layer from the package. A top layer includes a second adhesive on a bottom face surface that fixes the top layer to a top face surface of the base layer. The base layer and the first adhesive are formed with a slit that defines a hinge for enhancing separation of the base and top layers from the package upon manipulation of the starting tab.

16 Claims, 6 Drawing Sheets

FIG. 4
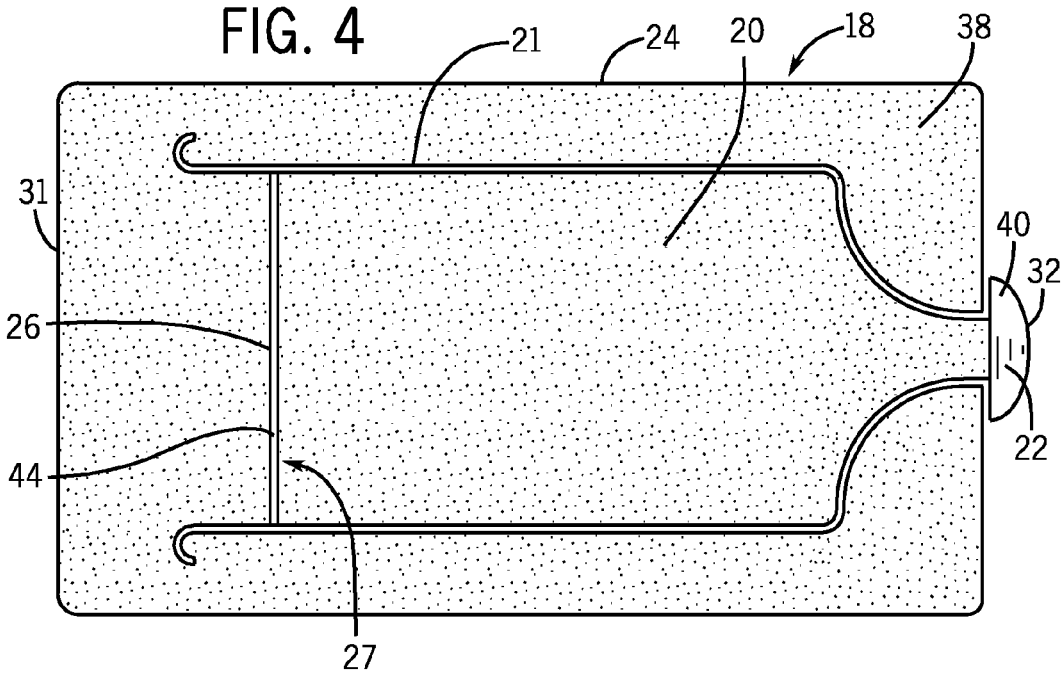
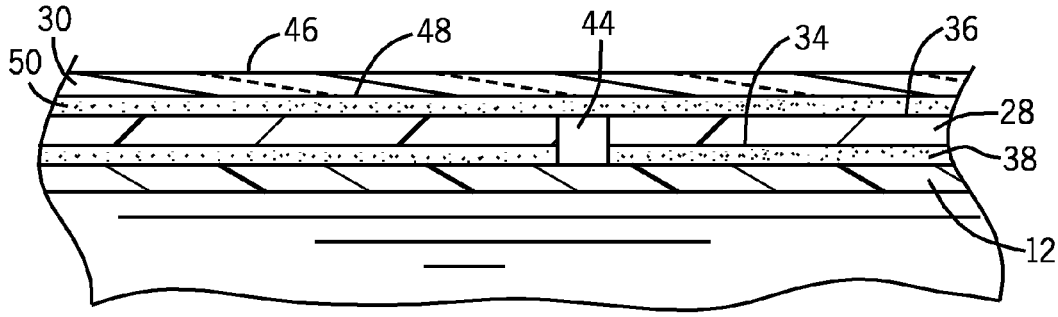
FIG. 5
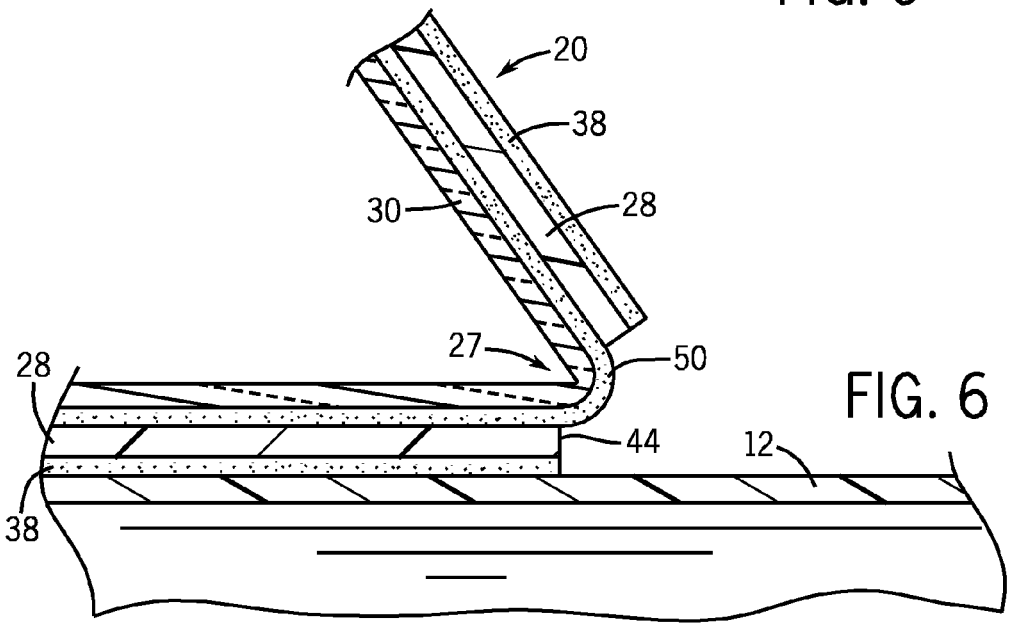
FIG. 6

RIGID RESEALABLE LABEL FLAP HAVING A HINGE

FIELD OF THE INVENTION

The present disclosure generally relates to a resealable label flap positionable to cover an opening in a product package containing removable articles such that the label flap is pivotally secured to the package and can be repeatedly removed and reapplied to access the articles contained within the package. More specifically, the present disclosure relates to a multi-layer, resealable label flap having a hinge formed in a rigid base layer to facilitate repeated opening and closing of the label flap on the package.

BACKGROUND

Resealable label flaps are commonly used with many different types of product packages. One common type of package that utilizes a resealable label flap includes packaged sheet-like removable articles that have been thoroughly wetted with a liquid prior to packaging. This specific product package is generally constructed from a thin, flexible, liquid-impervious material that has an opening over which the label flap is removably adhered. Typically, the label flap attached to the package is a strip of flexible or semi-rigid thermoplastic material having a removable pressure-sensitive adhesive applied to one surface of the label flap. The removable adhesive creates a generally air-tight seal around the package opening to prevent the packaged removable articles from drying out during storage.

In packaging of the type described above, as the articles are removed, a top surface of the flexible package may become deformed or waved. As a result, when an attempt is made to reattach the label flap to the package after opening, the label flap cannot be properly attached to the top of the package to create a seal around the package opening. In such situations, it is desirable to utilize a more rigid material for the resealable label flap and to incorporate a frame surrounding the resealable flap, which maintains the shape of the package better than conventional label flaps and ensures consistent proper sealing of the package. Bending a more rigid, pivotally secured label flap to access the opening in a package is more difficult than the use of a more flexible label flap.

One known container having a resealable label flap made of material which is stiffer than the container is set forth in U.S. Pat. No. 6,026,953 to Nakamura et al. The '953 patent discloses a single layer reinforcing sheet of between 100 and 130 micrometers having a cut line that defines a movable label flap with a starting tab. A crease is formed in the reinforcing sheet by the means of a press. The crease serves to define a hinge used in the opening and closing of the flap. The crease prevents the disengagement of the label flap from the reinforcing sheet. The problem with this approach is that creases in stiff, rigid materials do not form good hinges. A hard crease will create a hinge that bends easily, but the material tends to break at the hinge. A soft crease will create a hinge that bends hard, and resists bending back on reclosure of the label flap.

SUMMARY

The present disclosure relates to a resealable label flap positionable to cover an opening in a package. The label flap includes a base layer extending between a first end and a second end. The base layer includes a first adhesive on a bottom face surface that permits repeated application and separation of the base layer relative to the package. The base layer has a starting tab to permit removal of the base layer from the package. A top layer is attached to the base layer and includes a second adhesive on a bottom face surface that permanently attaches the top layer to a top face surface of the base layer. The base layer and the first adhesive on the bottom face surface thereof are formed with a slit that defines a hinge for enhancing separation of the base and top layers from the package upon manipulation of the starting tab.

The hinge-defining slit extends completely through the base layer and the first adhesive. The slit is located adjacent the first end of the base layer, and the starting tab is positioned at the opposite, second end of the base layer. The base layer and the top layer form a flap portion having an attachment end and a removable end including the starting tab. At least one of the base layer and the top layer can be printed with information. The resealable label flap may include a frame that extends substantially around the opening of the package. The top layer is coextensive with the base layer. The first adhesive is preferably a removable pressure-sensitive adhesive and the second adhesive is a permanent pressure-sensitive adhesive.

In another aspect of the disclosure, the resealable label flap is positionable to cover an opening in a package containing removable articles. The label flap includes a base layer extending between a first end and a second end. The base layer includes a first adhesive on a bottom face surface that permits repeated application and separation of the base layer relative to the package. The base layer has a starting tab to permit removal of the base layer from the package. A top layer is attached to the base layer and includes a second adhesive on the bottom face surface that securely attaches the top layer to a top face surface of the base layer to prevent separation therebetween. The base layer and the first adhesive are formed with a slit defining a hinge. The base layer, the first adhesive, the top layer and the second adhesive are formed to include a flap portion pivotally secured about the hinge to a frame extending substantially around the flap portion and reinforcing the package.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 4 is a bottom view of the resealable label flap shown in FIG. 1;

FIG. 5 is an enlarged sectional view taken on line 5-5 of FIG. 3;

FIG. 6 is a sectional view similar to FIG. 5 showing the resealable label flap moved to the open position via a hinge incorporated therein;

DETAILED DESCRIPTION OF THE DRAWINGS

Figure 1:
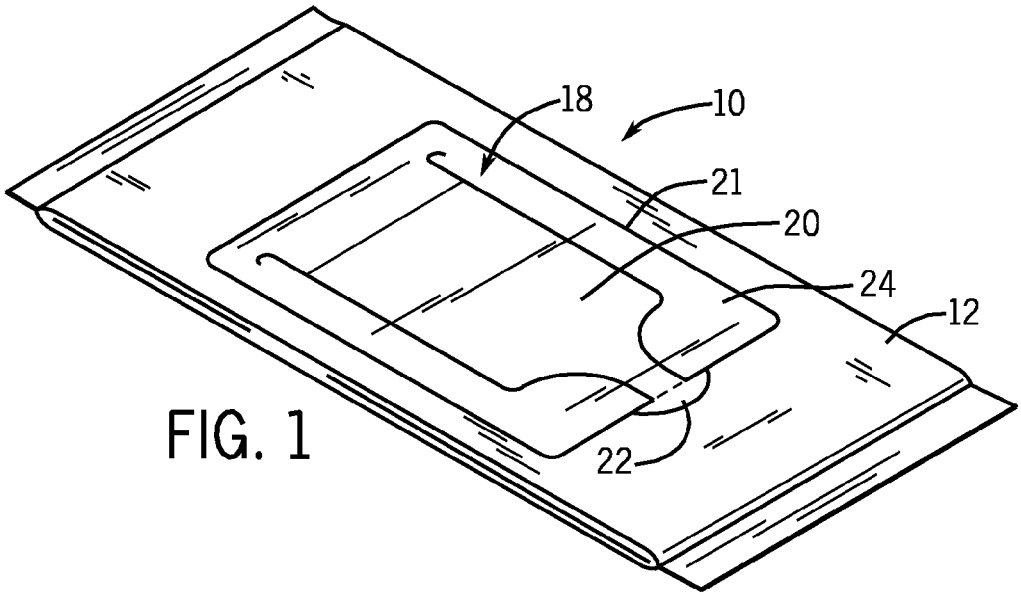
FIG. 1 is a perspective view of a resealable product package incorporating the resealable label flap of the present invention in a closed position.
Figure 2:
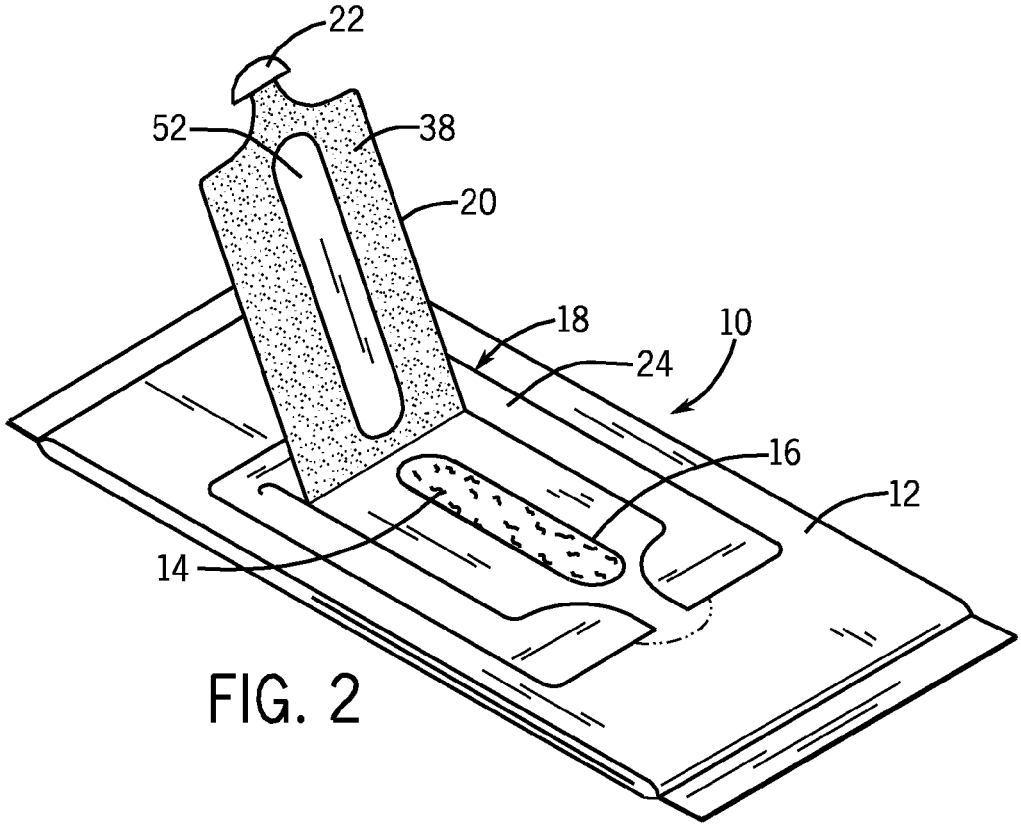
FIG. 2 is a perspective view similar to FIG. 1 showing the resealable label flap in an open position.
Figure 3:
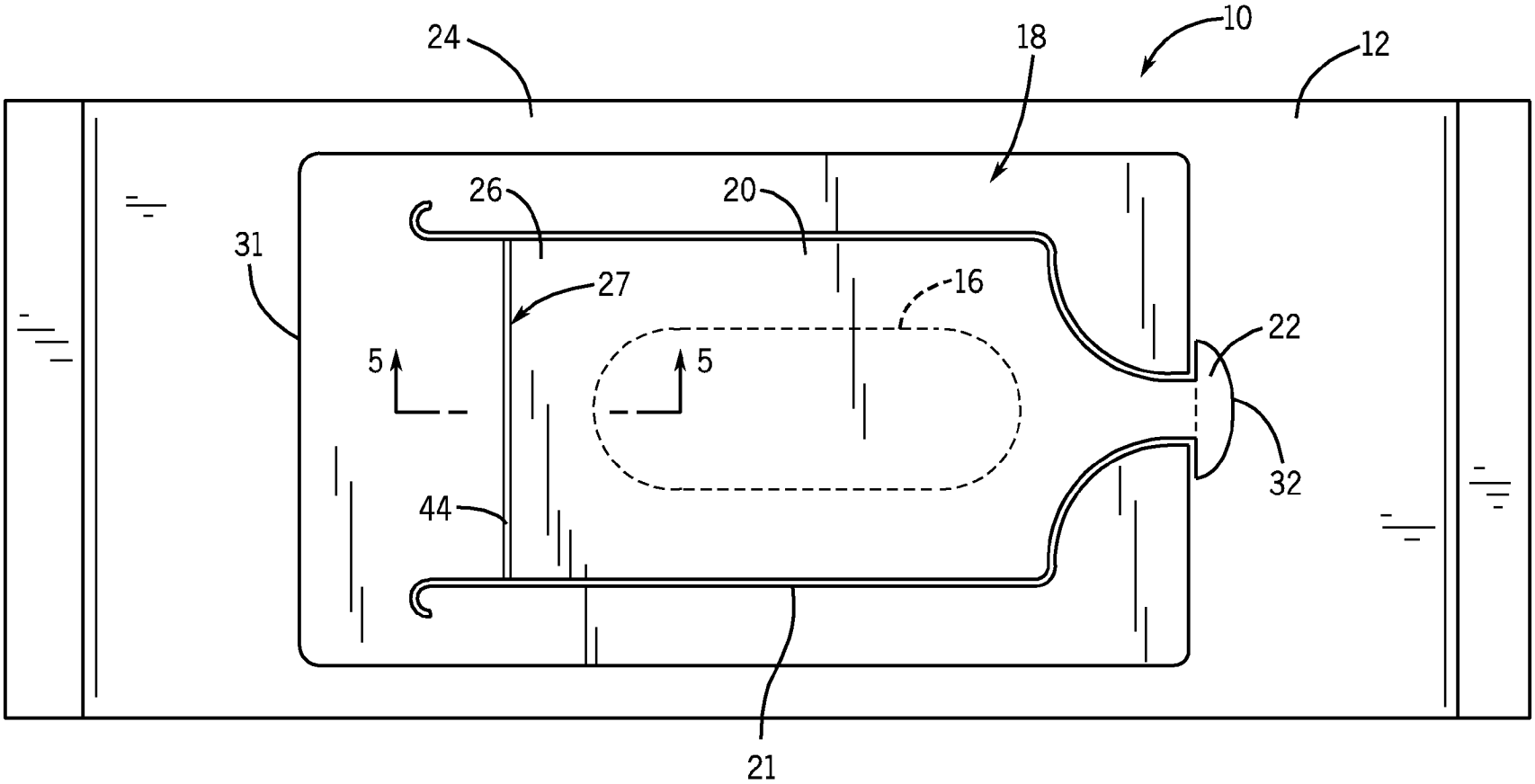
FIG. 3 is a top plan view of FIG. 1.

FIGS. 1-3 generally illustrate a resealable product package 10 having a main package body 12 formed by a cylinder of liquid-impervious, flexible, thermoplastic material heat sealed on each end to define an internal space for housing the removable articles contained within the product package 10. In the embodiment of the invention illustrated in FIGS. 1-3, the contents of the product package 10 comprise a series of stacked, individual cleaning cloths 14 that can be impregnated by appropriate cleaning solutions. For example, the cleaning cloths could be wetted baby wipes or hand towels. Although a specific product package is shown in the Figures, other types of packages for containing other types of products are contemplated. For example, the package could be a carton, lid or other shape that utilizes a resealable label flap.

As shown in FIG. 2, the package body 12 includes an opening 16 through the package body 12 to provide access into the internal space of the package body 12 containing the cleaning cloths 14. As can be readily understood, the individual products contained in the product package 10 can be removed from the internal space defined by the package body 12 through the opening 16.

The product package 10 further includes a resealable label flap 18 that is applied to the package body 12 to seal the package body 12 by covering the opening 16. The label flap 18 contacts the generally smooth, flat top surface of the package body 12, and forms a generally water and air-tight seal with the package body 12 around the opening 16. The water and air-tight seal around the opening 16 prevents contamination of the cleaning cloths 14 and prevents the cleaning cloths 14 from drying out.

The label flap 18 is resealably attachable to the upper surface of the package body 12 such that a flap portion 20 of the label flap 18 can be repeatedly opened and resealed to provide access to the cleaning clothes 14 contained within the internal space defined by the package body 12. The flap portion 20 is defined by a cut line 21 that separates the flap portion 20 from the outer frame 24. The label flap 18 includes the flap portion 20, the starting tab 22 and the frame 24 to which the flap portion 20 is pivotally secured. In general, a bottom surface of label flap 18 includes a removable adhesive that allows the flap portion 20 to be repeatedly peeled from the package body 12, and reapplied thereto in order to gain access to the opening 16 and then reseal the product package 10. The resealable adhesive contained on the flap portion 20 retains its adhesive properties during repeated application and removal of the flap portion 20 to the package body 12.

The starting tab 22 is a portion of the label flap 18 in which the adhesive on the label flap 18 is rendered ineffective or, in the alternative, not present such that the starting tab 22 does not adhere to the package body 20 and can be grasped by the user to pull the flap portion 20 from the package body 12. Referring now to FIG. 3, the flap portion 20 is defined by the cut line 21 and extends between a pivotal attachment end 26 and the starting tab 22. To ease opening of the flap portion 20, starting tab 22 extends to at least the periphery of the frame 24 and preferably therebeyond.

The frame 24 substantially surrounds the flap portion 20 as well as the package opening 16, and serves to reinforce the flexible upper surface of the package body 12. The frame 24 also functions to maintain the overall shape of the flexible package body 12 as products 14 are removably dispensed therefrom. As will be understood hereafter, the frame 24 is attached to the upper surface of the package 12 by the same adhesive applied to the bottom surface of the flap portion 20.

As can be best seen in FIGS. 5 and 6, the label flap 18 is a multi-layer member comprising a base layer 28 and a top layer 30 fixedly attached to the base layer 28. The base layer 28 and the top layer 30 are coextensive with one another, and extend between a first end 31 and a second end 32 which includes starting tab 22, as shown in FIG. 4. Referring back to FIG. 5, the base layer 28 has a thickness defined by a bottom face surface 34 and an opposed top face surface 36. The bottom face surface 34 of the base layer 28 includes a first adhesive 38 applied on the entire surface area of the bottom face surface 34. FIG. 4 illustrates that the first adhesive 38 completely covers the bottom face surface 34 of the base layer 28, including the flap portion 20, the starting tab 22 and the frame 24. A masking layer or coating 40 is applied over the first adhesive 38 at the removable second end 32 to define the starting tab 22. In an alternative embodiment, the first adhesive 38 may not be present along the portion of the bottom face 34 to define the starting tab 22.

In one embodiment of the disclosure, the base layer 28 is a single layer polymeric film, and the first adhesive 38 applied to the base layer 28 is a removable pressure-sensitive adhesive that retains its adhesive qualities as the flap portion 20 is peeled from the package body 12 and reapplied thereto. The first adhesive 38 has the desired adhesive properties to form a seal around the opening 16 while being able to be pulled from the package body 12 without damaging the thermoplastic material forming the package body 12. Although the base layer 28 is shown as being only a single layer, the base layer 28 could be formed from multiple layers bonded together to create the desired thickness for the base layer 28.

Figure 10:
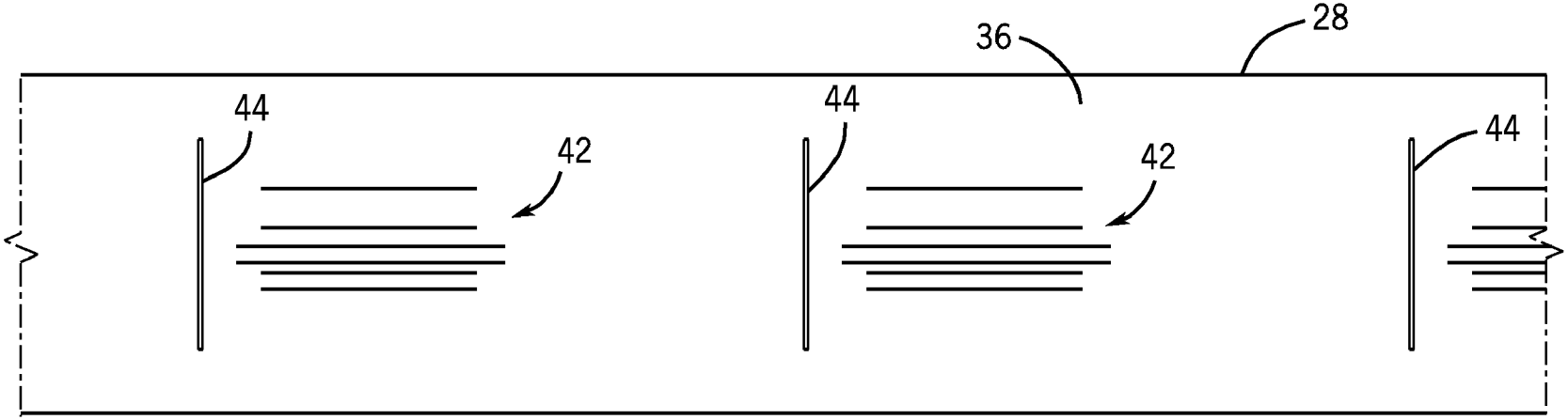
Figure 11:
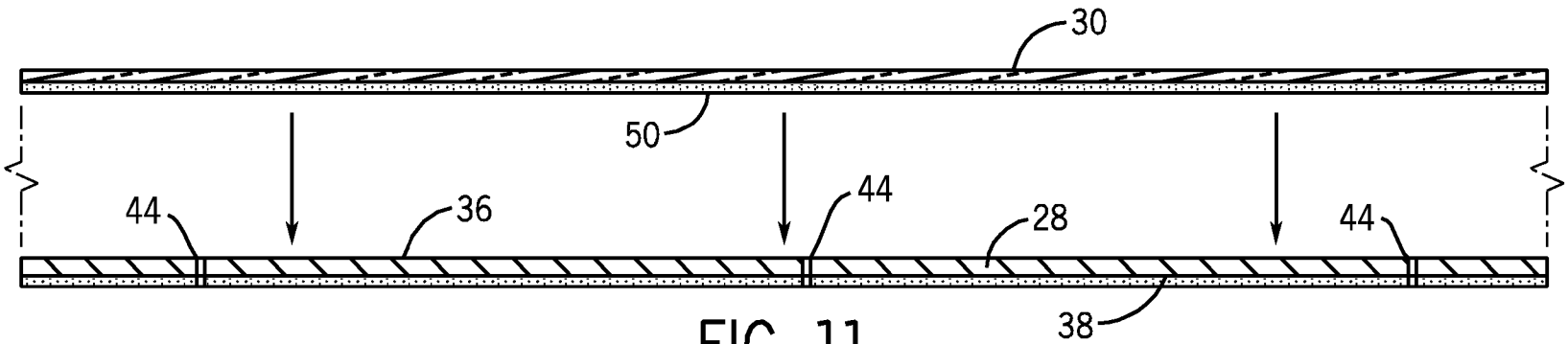
FIG. 11 is a diagrammatic illustration of the formation of the resealable label flap.
Figure 12:
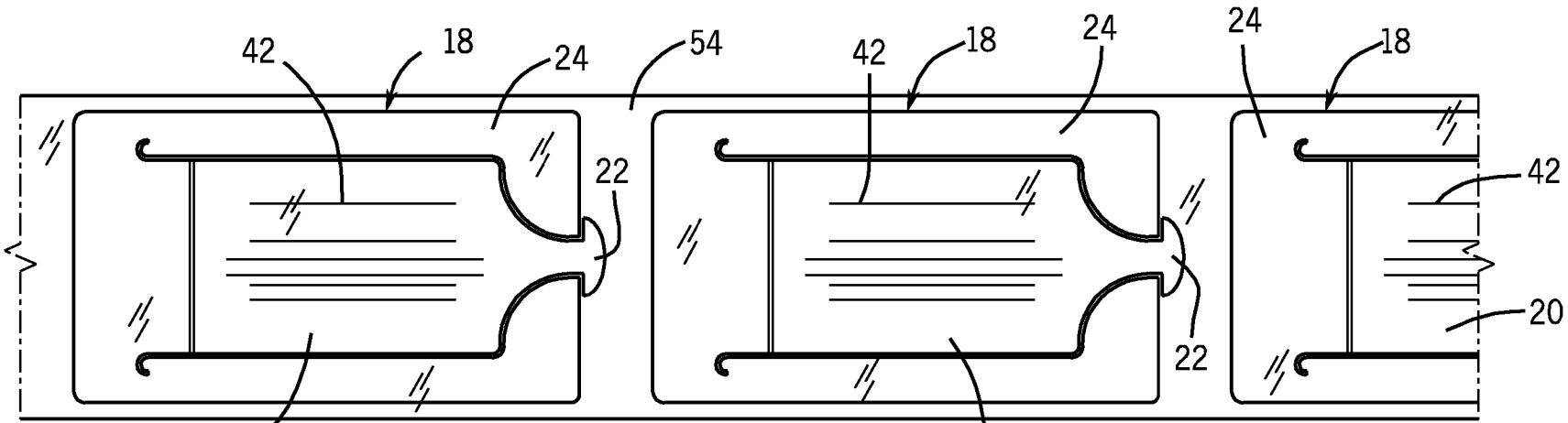
FIG. 12 shows a series of finished resealable label flaps mounted on a release liner.

A top face surface 36 of the base layer 28 may be printed with indicia 42, such as text or graphic images, as represented in FIG. 10. Such indicia 42 may conveniently include nutritional, safety, instructional, promotional, regulatory, multilanguage or other information to supplement the information carried on other parts of the package body 12. If desired, the top face surface 36 may be left unprinted.

Referring back to FIG. 4, the base layer 28 and the first adhesive 28 are formed with a cross cut or slit 44 that extends across the cut line 21 and defines a hinge 27 at attachment end 26 to enhance separation of the flap portion 20 from the package body 12 upon manipulation of starting tab 22. More specifically, the slit 44 extends completely through the thickness of the base layer 28 and the first adhesive 38, and extends generally across the flap portion 20 between opposite sides of the cut line 21 at the attachment end 26 thereof. The slit 44 is located adjacent the first end 31 of the base layer 28 opposite the second end 32.

As shown in FIG. 5, the label flap 18 is a multi-layer structure including the top layer 30 that is fixedly attached to the base layer 28 that defines flap portion 20, starting tab 22 and frame 24. The top layer 30 includes a top face surface 46 and a bottom face surface 48. In one embodiment, a second adhesive 50 is applied to the entire bottom face surface 48 of the top layer 30 as shown in FIGS. 5 and 6. The second adhesive 50 is a permanent pressure-sensitive adhesive that enables top layer 30 to be continuously joined to base layer 28. However, the top layer 30 could be attached to the base layer 28 using methods other than the second adhesive 50. The top layer 30 extends over the slit 44 formed in the base layer 28 and thus prevents the complete removal of the flap portion 20 from the frame 24 and package body 12 during normal usage of the label flap 18 as shown in FIG. 6. The top layer 30 is preferably a polymeric film that may or may not be printed with text and/or graphic images on the top face surface 46. Additionally, the top layer 30 could be formed from either a single layer or multiple layers bonded together.

When the label flap 18 is positioned on the package body 12, the removable first adhesive 38 applied to the base layer 28 is pressed into contact with the package body 12, and the base layer 28 covers the entire opening 16.

When a user desires to access the products 14 contained within the package 10, the user first grabs the starting tab 22. Once the starting tab 22 has been grasped, the user pulls back on the flap portion 20 shown in FIG. 1 to overcome the removable adhesive bond between the removable first adhesive 38 and the package body 12. The user continues to pull back on the flap portion 20, causing the flap portion 20 to separate from the frame 24 along the cut line 21 until the flap portion 20 has been pulled out of contact with the package body 12 and away from frame 24, as seen in FIG. 2. Frame 24 remains attached to the upper surface of package body 12, and serves to anchor the flap portion 20 during pivotal movement thereof while providing reinforcement for the package body 12.

As shown in FIG. 2, the first time the flap portion 20 is pulled from the package body 12, a perforated oval covering 52 separates from the package body 12 to define the opening 16. The oval covering 52 remains adhesively attached to the flap portion 20, and prevents contact between the first adhesive 38 and cleaning cloths 14.

After the desired number of cleaning cloths 14 has been removed from the opening 16, the user repositions the flap portion 20 over the opening 16. The first adhesive 38 reseals the flap portion 20 onto the package body 12 to form the required air-tight seal around the opening 16.

In accordance with the present disclosure, the opening and pivotal movement of the flap portion 20 relative to the frame 24 and package body 12 are enhanced by the hinge 27, which is defined by the portion of the top layer 30 extending over the slit 44. Formation of the slit 44 in only the base layer 28 and the first adhesive 38 permits the user to pull back and pivot the flap portion 20 at hinge 27, at which point only the top layer 30 connects the flap portion 20 to the rest of the base layer. The separation of the portion of the base layer 28 defining the flap portion 20 from the frame 24 creates a tactile response, indicating no further opening effort is required. Upon reaching the hinge 27, the base layer 28 and underlying adhesive 38 cleanly break away from the upper surface of the package 10. However, removal or disengagement of the flap portion 20 from the frame 24 and package 10 is prevented because of the portion of the top layer 20 extending over the slit 44. As a result, easy bending occurs along slit 44 at the top layer 30 and the second adhesive 50 (as shown in FIG. 6) without incurring any breakage of the defining layers of the flap portion 20. Once flap portion 20 is opened, the hinge 27 may enable the user to access products 14 from the package 10 without constantly holding the flap portion 20. The hinge 27 is also beneficial in enabling easy closing of the flap portion 20 onto the package body 12.

The frame 24 used in the embodiment of FIGS. 1-3 allows a stiffer material to be used for the label flap 18. When using label flap 18 with the frame 24, it should be appreciated that locating the starting tab 22 beyond the periphery of the frame 24 further improves the accessibility of starting tab 22 so that the flap portion 20 can be quickly opened.

Referring now to FIGS. 9-12, the formation of the label flap 18 shown in FIGS. 1-3 will now be described. Initially, a continuous base material comprised of the base layer 28 and the first adhesive 38 is unwound. A coating 40 is applied to the first adhesive 38 at a location corresponding to the starting tab 22. The coating renders the first adhesive 38 ineffective to form starting tab 22.

After the starting tab 22 has been formed, printing may or may not be provided on the top face surface 36 of base layer 28. The base layer 28 and the first adhesive 38 are then cut therethrough with cross cuts or slits 44. The top layer 30 (which may or may not be printed) and the second adhesive 50 are then applied to the top face surface 36 of base layer 28 as indicated by the arrows in FIG. 11. Once the top layer 30 has been applied to base layer 28, the shape of the label flap 18 is cut to form the frame 24 and the flap portion 20. The finished label flaps 18 are then mounted in spaced apart relationship on a continuous protective release liner 54.

Figure 7:
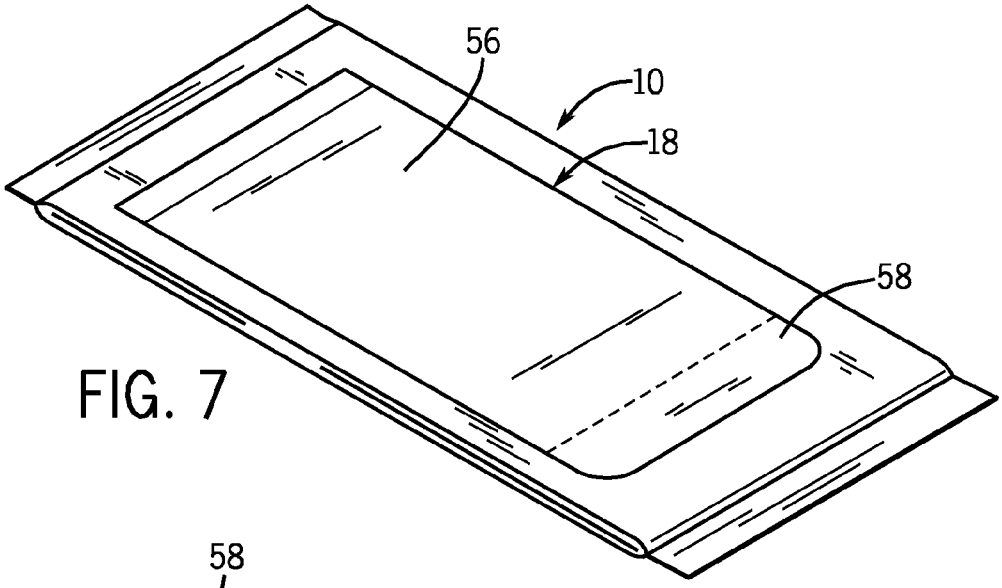
FIGS. 7 and 8 show an alternative embodiment of the resealable label flap in closed and opened positions, respectively.
Figure 8:
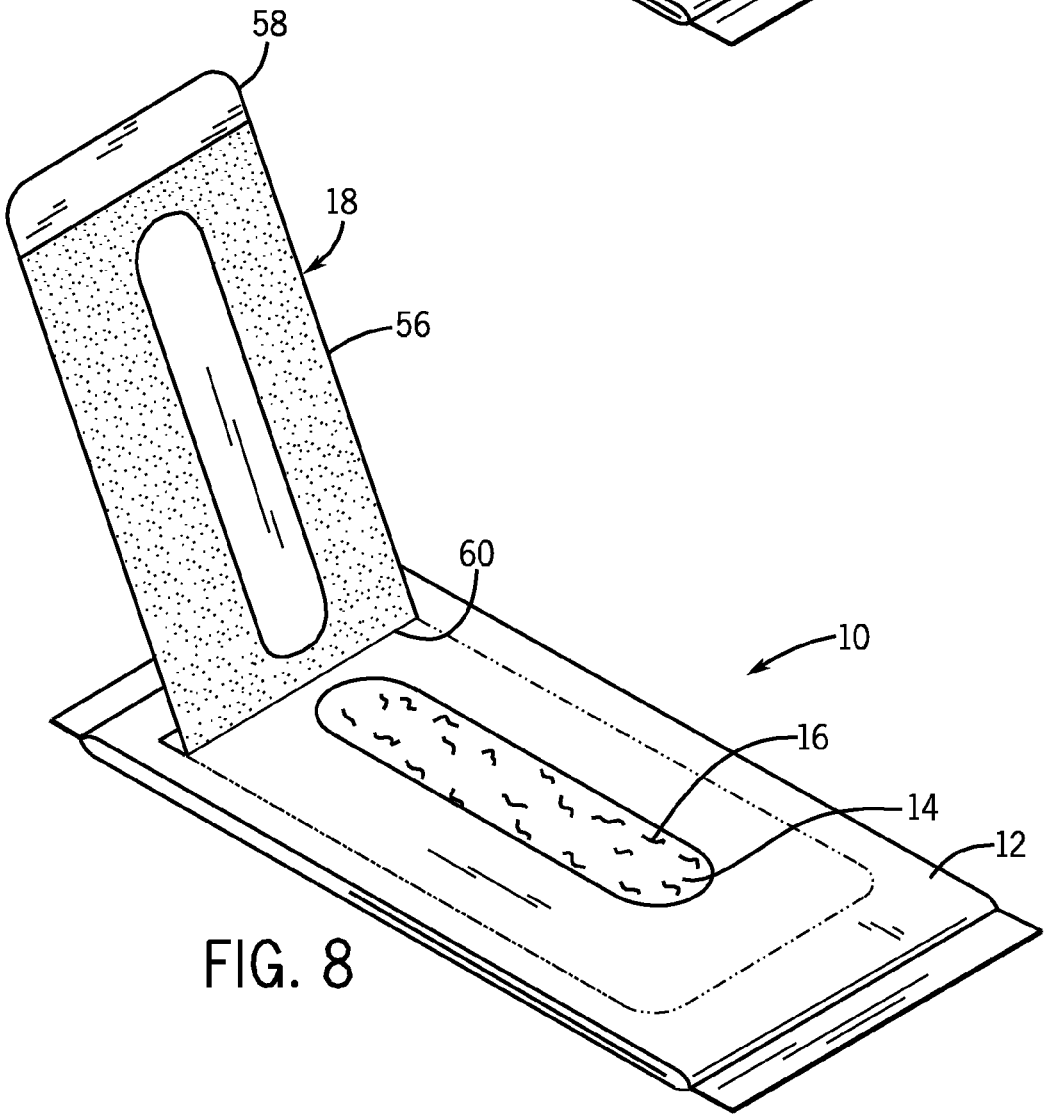
Figure 9:
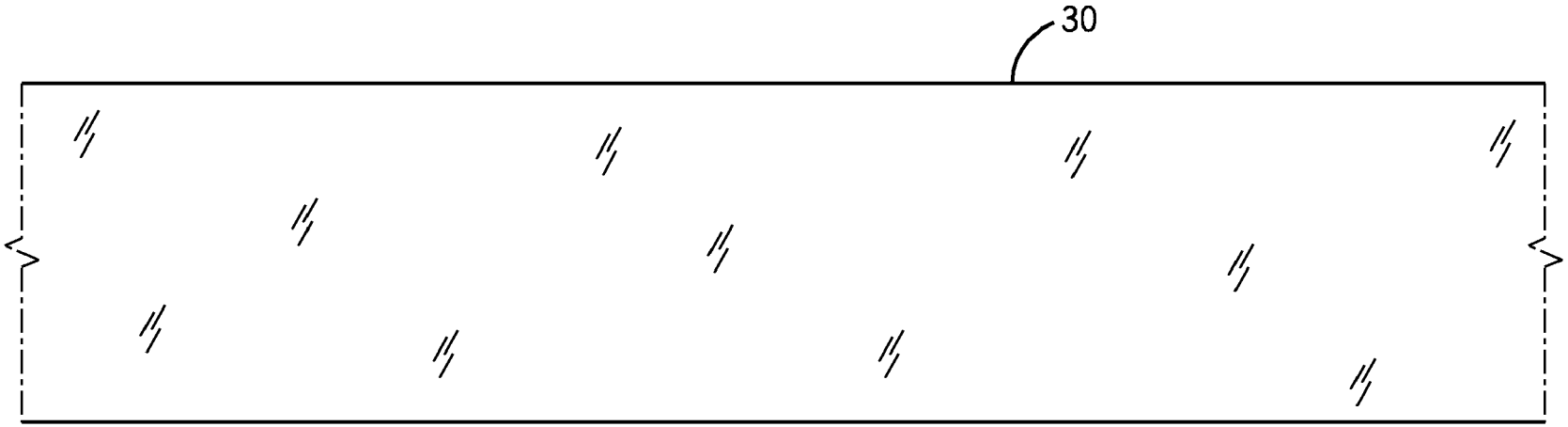
FIGS. 9 and 10 are plan views of respective continuous top and base layers used in forming the resealable label flap.

Although the label flap 18 of the present invention has been described as including a frame 24, an alternative embodiment is shown in FIGS. 7 and 8 wherein the label flap 18 is comprised of only a flap portion 56 including a starting tab 58. Here, the construction of the label flap 18 commonly includes a hinge 60 similar to hinge 27 described above.

In the embodiment shown, the base layer 28 is preferably opaque and thicker than top layer 30 which is preferably clear. However, it should be understood that the base layer 28 and the top layer 30 may be formed of various clear, translucent and opaque materials having varying thicknesses/thickness. The base layer 28 which is shown as a single layer may be formed by more than one layer with printing between the layers, if desired.

Various alternative and embodiments are contemplated as being within the scope of the following claims particularly pointing out and distinctly claiming the subject matter regarded as the invention.

We claim:

1. A resealable label flap positionable to cover an opening in a package, the label flap comprising:

a base layer extending between a first end and a second end, the base layer including a first adhesive on a bottom face surface that permits repeated application and separation of the base layer relative to the package, the base layer having a starting tab formed near the second end to permit removal of the base layer from the package;

a top layer attached to a top face surface of the base layer;

a flap portion formed as a repeatably removable portion of the label flap from the combined base layer and top layer, the flap portion extending between an attachment end and a removable end including the starting tab; and a slit formed in only the base layer and the first adhesive at the attachment end of the flap portion opposite the starting tab, wherein the top layer extends over the slit to define a hinge, wherein the hinge allows the portion of the base layer that forms the flap portion to completely separate from the package in an open position, thus eliminating the flexing of the base layer and allowing the flap portion to remain in the open position.

2. The resealable label flap of claim 1, wherein the base layer and top layer further defines a frame extending substantially around the flap portion, wherein the flap portion is positioned to resealably cover the opening in the package and wherein the frame remains adhered to the package as the flap portion is removed to uncover the opening.

3. The resealable label flap of claim 1, wherein the top layer includes a second adhesive to adhere the top layer to the base layer.

4. The resealable label flap of claim 3, wherein the first adhesive is a removable pressure-sensitive adhesive and the second adhesive is a permanent pressure-sensitive adhesive.

5. The resealable label flap of claim 1, wherein the top layer is coextensive with the base layer.

6. A resealable label flap positionable to cover an opening in a package containing removable articles, the label flap comprising:

a base layer extending between a first and a second end, the base layer including a first adhesive on a bottom face surface that permits repeated application and separation of the base layer relative to the package; and a top layer attached to a top face surface of the base layer;

a flap portion formed as a repeatably removable portion of the label flap from the combined base layer and top layer, the flap portion extending between an attachment end and a removable end;

a starting tab formed near the removable end of the flap portion;

a frame surrounding at least a portion of the flap portion; and a slit formed in only the base layer and the first adhesive at the attachment end of the flap portion opposite the starting tab, where the top layer extends over the slit to define a hinge, wherein the hinge allows the portion of the base layer that forms the flap portion to completely separate from the package in an open position, thus eliminating the flexing of the base layer and allowing the flap portion to remain in the open position.

7. The resealable label flap of claim 6, wherein the starting tab extends to at least a periphery of the frame.

8. The resealable label flap of claim 6, wherein the slit extends completely through the base layer and the first adhesive.

9. The resealable label flap of claim 6, wherein the top layer includes a second adhesive to adhere the top layer to the base layer.

10. The resealable label flap of claim 6, wherein the slit underlies the attachment end.

11. The resealable label flap of claim 6 wherein the flap portion is formed in the base layer by a cut line extending through the base layer, the first adhesive and the top layer, wherein the slit extends across the cut line at the attachment end of the flap portion through only the base layer and the first adhesive.

12. The resealable label flap of claim 11 wherein the flap portion is separated from the frame by the cut line.

13. A resealable package comprising:

a package body having an internal space sized to contain a plurality of removable articles;

an opening through the package body to the internal space for accessing the removable articles; and a resealable label flap positioned on the package and having a flap portion to cover the opening in the package, the label flap including:

a base layer extending between a first end and a second end, the base layer having a bottom face surface positionable in contact with the package and an opposed top face surface, the bottom face surface including a first adhesive applied thereto that permits repeated application and separation of the base layer relative to the package, the flap portion having a starting tab located at the second end; and a top layer having a bottom face surface attached to the top face surface of the base layer;

wherein the base layer and the first adhesive are formed with a slit at the attachment end of the flap portion such that the top layer extends over the slit to define a hinge, wherein the hinge allows the portion of the base layer that forms the flap portion to completely separate from the package in an open position, thus eliminating the flexing of the base layer and allowing the flap portion to remain in the open position.

14. The resealable package of claim 13 wherein the base layer and top layer further define a frame extending substantially around the flap portion, wherein the frame remains adhered to the package as the flap portion is removed to uncover the opening.

15. The resealable package of claim 14 wherein the flap portion is formed in the resealable label flap by a cut line extending through the base layer, the first adhesive and the top layer, wherein the slit extends across the cut line through only the base layer and the first adhesive.

16. The resealable package of claim 15 wherein the flap portion is separated from the frame by the cut line.

* * * * *